US008359883B2

(12) United States Patent
Dholakiya

(10) Patent No.: US 8,359,883 B2
(45) Date of Patent: Jan. 29, 2013

(54) GEMSTONE SETTING

(76) Inventor: Hasmukh Dholakiya, Rutherford, NJ (US)

( * ) Notice: Subject to any disclaimer, the term of this patent is extended or adjusted under 35 U.S.C. 154(b) by 0 days.

(21) Appl. No.: 12/618,215

(22) Filed: Nov. 13, 2009

(65) Prior Publication Data

US 2011/0113826 A1 May 19, 2011

(51) Int. Cl.
*A44C 17/02* (2006.01)

(52) U.S. Cl. ..... 63/28; 63/26

(58) Field of Classification Search ..... 63/28, 24
See application file for complete search history.

(56) References Cited

U.S. PATENT DOCUMENTS 802,267 A * 10/1905 Chaumet ..... 63/28
884,979 A * 4/1908 Fishel ..... 63/28
1,238,721 A * 8/1917 Bimbaum et al. ..... 63/28
1,854,958 A * 4/1932 Santosuosso ..... 63/28
5,377,506 A * 1/1995 Tranzer ..... 63/28
5,419,159 A * 5/1995 Muller ..... 63/28
5,632,164 A * 5/1997 Bergagnini ..... 63/23
D388,016 S * 12/1997 Kejejian ..... D11/91
D388,017 S * 12/1997 Kejejian ..... D11/91
5,848,539 A * 12/1998 Ouzounian ..... 63/28
6,003,335 A * 12/1999 Gurevich et al. ..... 63/26
6,026,660 A * 2/2000 Lai ..... 63/26
6,065,308 A * 5/2000 Piat et al. ..... 63/37
6,293,129 B1 * 9/2001 Gurevich ..... 63/28
6,415,629 B1 * 7/2002 Chan ..... 63/26
6,442,971 B1 * 9/2002 Gurevich ..... 63/28
D468,228 S * 1/2003 Gurevich ..... D11/91
D473,816 S * 4/2003 Gurevich ..... D11/91
2004/0182110 A1 * 9/2004 Giladi ..... 63/28

* cited by examiner

*Primary Examiner* — Jack W Lavinder
*Assistant Examiner* — Emily Morgan
(74) *Attorney, Agent, or Firm* — Jennifer Meredith, Esq.; Meredith & Keyhani, PLLC

(57) ABSTRACT

Jewelry apparatus, a setting for gemstones and a method of setting gemstones in jewelry. The setting includes a base that is formed by walls and a sunk surface between the top and bottom of the base walls. Within the base, the sunk surface is divided into cavities by braces that partially enclose each cavity. Each cavity is partially circumscribed by the braces for holding the gemstone within each cavity. Each cavity has a bottom opening formed in the sunk surface for the pavilion of the gemstone to pass through. Girdles of the gemstones lie above the braces and are close together through the openings between the braces of adjacent cavities. Light passes through the pavilion that protrudes through the bottom openings and between adjacent gemstones through openings between the cavities. The passage of light creates a carpet setting with improved appearance.

16 Claims, 16 Drawing Sheets

100

100

700

6.75mm X 6.75mm

1210

8.00mm X 8.00mm

1220

1230

8.15mm X 8.15mm

GEMSTONE SETTING

BACKGROUND OF THE INVENTION

1- Field of the Invention

The present invention relates generally to jewelry settings and jewelry apparatus and to a method for setting gemstones in a piece of jewelry and, more particularly, to a jewelry setting for round gemstones.

2- Description of Related Art

Gemstones can be set in a piece of jewelry in a number of ways. For example, jewelry settings and setting methods include prong setting, channel setting, bead setting, burnish setting and invisible setting.

FIG. 9 shows a conventional gemstone and is used to define the terminology associated with gemstones. Faceted stones, which have the general overall shape of the modern diamond, have a thin edge, called the girdle, the top angling up into what is called the crown and the bottom angling down into what is called the pavilion. A crown 912, a pavilion 914 and a girdle 916 are shown with respect to gemstone 910 in FIG. 9.

To be usable as jewelry, gemstones are mounted in settings and the settings are typically made from precious metal material such as silver, gold or platinum.

One common jewelry setting and method of setting a gemstone is prong setting. A prong setting comprises at least two thin metal supports that extend from a common base to wrap around and grip opposing upper edges of the girdle of a gemstone. The base of the prong setting is typically attached to a piece of jewelry, such as a ring, to secure the gemstone to the piece of jewelry. While prong setting is an easy and economical method of securing a gemstone to a piece of jewelry, the metal supports are clearly visible and detract from the beauty of the gemstone. Since the supports are exposed, they are also subject to breakage and loss of the gemstones.

Channel setting is another jewelry setting and another method of setting gemstones in a piece of jewelry. A channel setting comprises a U-shaped channel for holding a row of gemstones in place in the piece of jewelry. The gemstones are placed in the channel and grooves in the opposing walls of the channel engage the girdle of the gemstones. The gemstones are held in the channel by the two opposing walls and grooves in the walls. Channel settings share some of the problems of prong settings, namely, that the opposing walls of the setting are visible and detract from the beauty of the gemstones.

Another type of gemstone setting method is the so-called invisible setting method. As the name suggests, the gemstone-securing structure of an invisible setting method is not visible when the gemstone is installed. One conventional invisible setting method requires a groove to be cut in the lower surfaces or pavilion of the gemstone. Two parallel rails are included in the setting and are configured to engage the grooves in the gemstone to secure the gemstone onto the jewelry piece. The rails are concealed from view by the girdle and crown of the gemstones. Also, multiple gemstones can be set with their adjacent edges juxtaposed so that the rails are not visible between the gemstones.

The invisible setting method produces stunning visual effects because the setting is not visible between the gemstones and the gemstones appear to look like one gemstone. However, the method is difficult and expensive to implement and its use is limited. For example, this method only works well with specific gemstone shapes such as square or princess cut gemstones. Also, because it requires grooves to be cut into the gemstone, it adversely impacts the luster, quality and value of the gemstone.

SUMMARY OF THE INVENTION

Aspects of the present invention provide a setting for gemstones and a method of setting gemstones which is inexpensive and versatile, enhances the life, value and brilliance of gemstones, such as round diamonds, and appears as a carpet. Aspects of the present invention also provide a jewelry apparatus including gemstones in a carpet setting.

The method and apparatus of the aspects of the present invention provide a sturdy hold for the gemstones while keeping the distance between adjacent gemstones to a minimum. The sharpness of the edge of the gemstones at the top provides additional luster and a continuous look. The angle of the gemstone and the opening in the back of the setting provide more room for light to pass and more luster for the gemstone. The gemstone is set to stand higher than the setting and the height permits the gemstone to reflect light off the crown. Ridges on the setting walls help keep the gemstone in place and prevent it from sliding from side to side or from popping out.

Aspects of the present invention provide a carpet setting that, when compared with an invisible setting and a micro-pave setting, is less expensive while providing a superior appearance.

One aspect of the present invention provides a setting including a base that is formed by walls and a sunk surface between the top and bottom of the base walls. Within the base, the sunk surface is divided into cavities by braces that partially enclose each cavity. Each cavity is partially circumscribed by the braces for holding the gemstone within each cavity. Each cavity has a bottom opening formed in the sunk surface for the pavilion of the gemstone to pass through. Girdles of the gemstones lie above the braces and are close together through the openings between the braces of adjacent cavities. Light passes through the pavilion that protrudes through the bottom openings and between adjacent gemstones through openings between the cavities. The passage of light creates a carpet setting with improved appearance.

One aspect of the present invention provides a jewelry apparatus that includes a setting with rectangular cavities arranged along rows. Each rectangular cavity is formed by four corner braces, is open to a top side of the setting and is also open on a bottom side through a rectangular bottom opening that is smaller than the top opening. Four walls of each rectangular cavity are open except near the corners. The rows of rectangular cavities are adapted for receiving round gemstones and holding the gemstones in place. Each of the round gemstones comprises a crown and a pavilion. In the setting, the pavilion is placed through the bottom opening and the crown stands slightly above the corner braces such that the girdles of the gemstones in two adjacent rectangular braces are close and a carpet setting is created.

One aspect of the present invention provides a method for making a jewelry apparatus by placing round gemstones in rectangular cavities arranged in rows where the pavilion of each gemstone is inserted through a bottom opening in the rectangular cavity and a crown of each gemstone sits in the rectangular cavity such that the girdle of the gemstone locates above an upper rim of the braces of the rectangular cavity.

Aspects of the present invention provide a jewelry setting including a base and braces located on a sunk surface of the base and delimiting cavities on the sunk surface for receiving gemstones. The base includes base walls enclosing the base, and the sunk surface located between a top and a bottom of the wall. Each of the cavities is open on top to permit a crown of a gemstone to fit above the braces. The sunk surface at a bottom of each of the cavities includes a bottom opening adapted to fit a pavilion of the gemstone. The braces partially circumscribe each cavity leaving openings between adjacent cavities, and the braces include ridges adapted to hold the gemstones in the cavities.

In various aspects of the present invention, the setting may be made from metal. The base may have a rectangular circumference circumscribing the cavities. The base may have a circular circumference circumscribing the cavities. The sunk surface may be a planar surface. The sunk surface may be a curved surface adapted for forming a ring, an earring, a choker, a bracelet, an anklet or an arm band. The braces of each of the cavities may be straight walls perpendicular to the sunk surface. The braces of each of the cavities may be tapered walls reaching the sunk surface at an angle adapted for fitting the pavilion of the gemstone. The braces of each of the cavities may include ridges for holding the gemstone in place. The cavities may be arranged in rows. The cavities may be selected from triangular, circular, rectangular or polygonal in perimeter. The braces may be adapted to match the intended shape of the cavities. The gemstones may be substantially the same size and round. The gemstones may be fitted in the cavities to form a jewelry apparatus. The jewelry apparatus may be selected from a group consisting of a ring, an earring, a bracelet, an anklet, a choker, a necklace and a pendant. The gemstones may be diamonds.

Aspects of the present invention provide a method for forming a jewelry apparatus. The method includes forming a setting including a base including walls enclosing the base, a sunk surface located between a top and a bottom of the wall, and braces for forming cavities on the sunk surface by locating the braces around an intended perimeter of each cavity on the sunk surface, the cavities being adapted for receiving gemstones, each of the cavities is open on top to permit a crown of a gemstone to fit above the braces, the sunk surface at a bottom of each of the cavities includes a bottom opening adapted to fit a pavilion of the gemstone, and the braces partially circumscribe each cavity leaving openings between adjacent cavities, fitting gemstones in the cavities of the setting, and holding the gemstones in the cavities by ridges formed in the braces.

In various aspects of the present invention, the girdles of the gemstones may be fitted above the braces and the girdles of adjacent gemstones approach each other through the openings between adjacent cavities. The pavilions of the gemstones may protrude through the bottom openings of the cavities and receive light from below the setting.

DETAILED DESCRIPTION OF THE INVENTION

Aspects of the present invention provide a jewelry setting for round gemstones, a jewelry apparatus including round gemstones and a method of making a jewelry apparatus including round gemstones. The devices and methods of the aspects of the present invention provide a carpet setting for gemstones including diamonds. The setting when used with diamonds as gemstones improves the value of the diamonds. The setting provides a sturdy hold for the diamonds while minimizing the distance between two adjacent diamonds. Edges of girdles stand above the setting and sharpness of edges of girdles adds shine to the carpet setting of the diamonds. The pavilions pass through openings in the bottom of cavities holding each gemstone and receive additional light that could have been obstructed by a closed-bottom setting.

Figure 1:
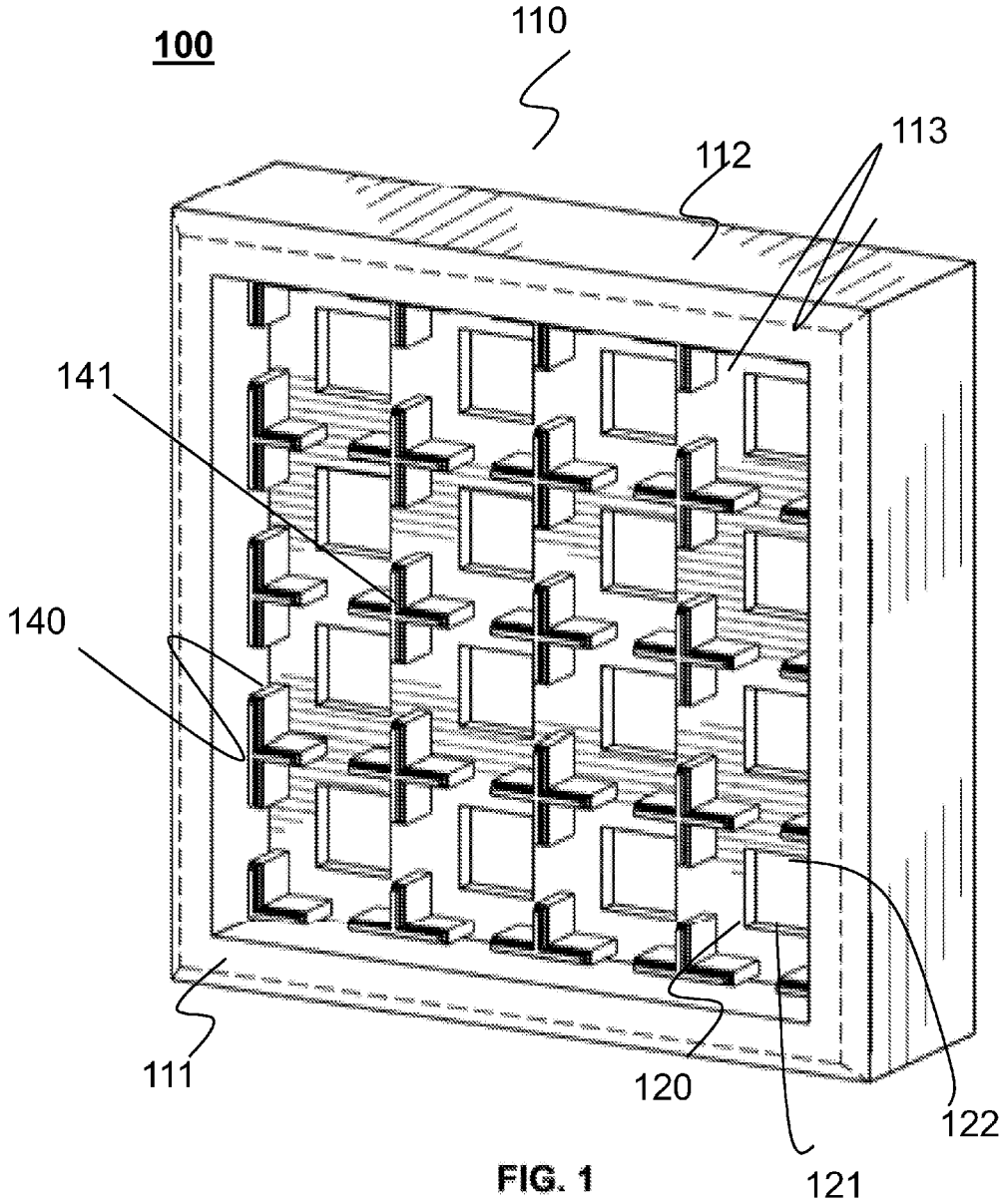
FIG. 1 shows a front perspective view of a jewelry setting, according to aspects of the present invention.

FIG. 1 shows a front perspective view of a jewelry setting, according to aspects of the present invention.

Figure 2:
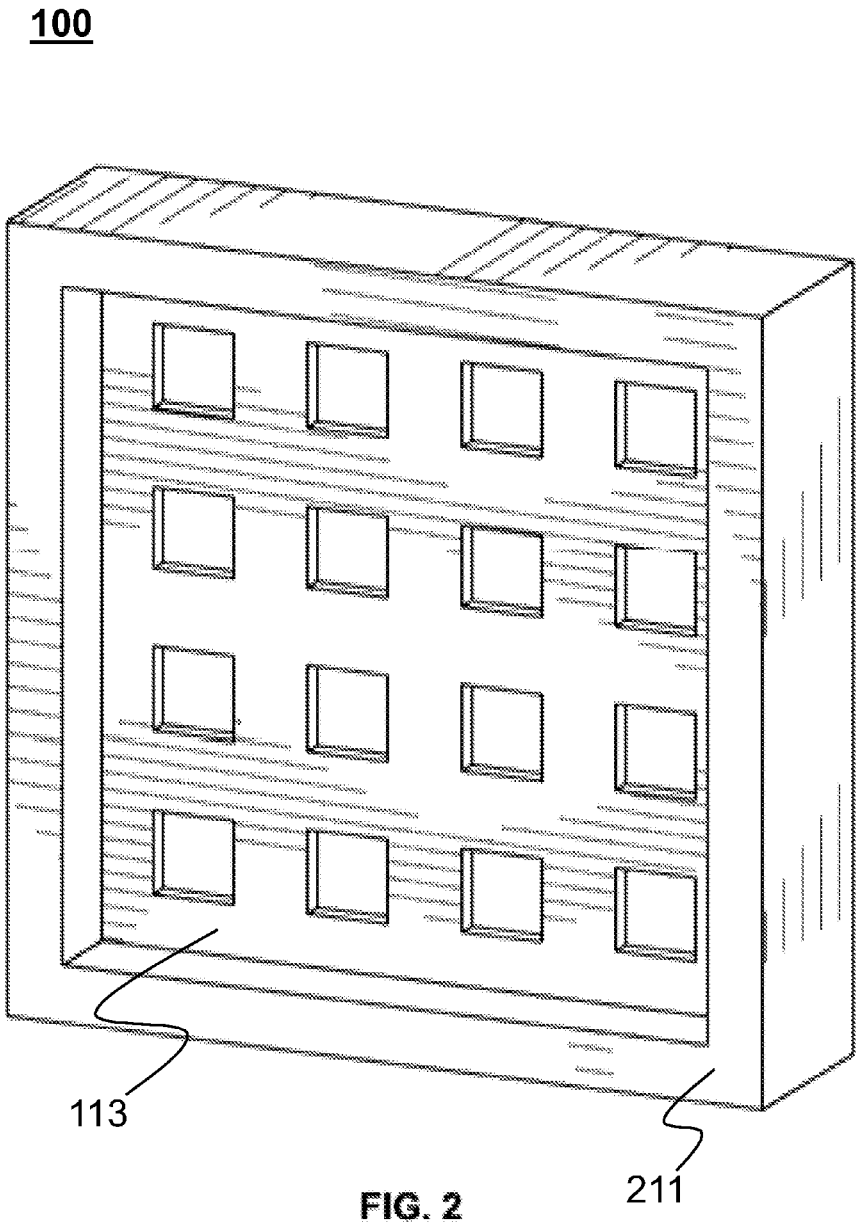
FIG. 2 shows a back perspective view of the jewelry setting of FIG. 1, according to aspects of the present invention.

A rectangular jewelry setting 100 is shown in perspective. The setting 100 includes a base 110. The base 110 includes a base top 111, four base walls 112 and a base bottom 211 that is shown in FIG. 2. The walls 112 of the base 110 circumscribe a sunk surface 113 that is a plane set between the base top 111 and the base bottom 211. In alternative aspects, the sunk surface may be a curved surface adapted, for example, for fitting around the finger as a ring. The sunk surface 113 is divided into rows of rectangular cavities 120. Each rectangular cavity 120 has a cavity top 121, which is open, and a cavity bottom that is formed by the sunk surface 113 but includes a cavity bottom opening 122 through the sunk surface 113.

Each cavity 120 is formed by short walls or braces 140 that are formed only at the cavity corners 141 such that the adjacent cavities 120 are connected by the open spaces between each two adjacent cavity corners 141. The short braces 140 are formed on the sunk surface 113 and are shorter in height than the base walls 112. These short walls or braces extend a distance from and above the sunk surface 113. The short braces 140 appear as +shaped walls (50) in the corners between four adjacent cavities 120, as T shaped walls (54) at the base walls 112 of the setting 100, and as L shaped walls (52) at the corners of the setting 100. The sides of the braces 140 are usually of the same size (width, length and height) such that symmetrical shapes are formed by the braces.

Gemstones are placed in the cavities 120 such that the pavilion of the gemstone passes through the cavity bottom opening 122 and is held in place by the braces 140.

The cavities are shown as rectangular spaces formed in rows on the sunk surface by braces that partially enclose each cavity. However, the cavities may be formed in another shape. For example, the braces may be placed such that the cavities are circular, triangular or polygonal along their perimeter on the sunk surface.

The jewelry setting 100 shown in FIG. 1 is rectangular. However, as shown in FIG. 10B, by managing the corner areas, the same principle shown in FIG. 1 may be used to create a round setting.

Further, the base, and its walls and the sunk surface, may all follow a curved shaped appropriate for a ring, an earring or a choker.

Finally, while the base is shown as having walls that may be higher than the braces, in some aspects of the present invention, the base may have walls that are only as high as the braces or shorter or may have no walls at all.

FIG. 2 shows a back perspective view of the jewelry setting of FIG. 1, according to aspects of the present invention.

FIG. 2 shows the back view such that the base bottom 211 and the bottom of the sunk surface 113 are apparent in FIG. 2. As seen in this drawing, the sunk surface 113 is located between the base top 111 and the base bottom 211 such that the pavilion of a gemstone set in the cavities does not protrude farther down than the base bottom 211.

Figure 3:
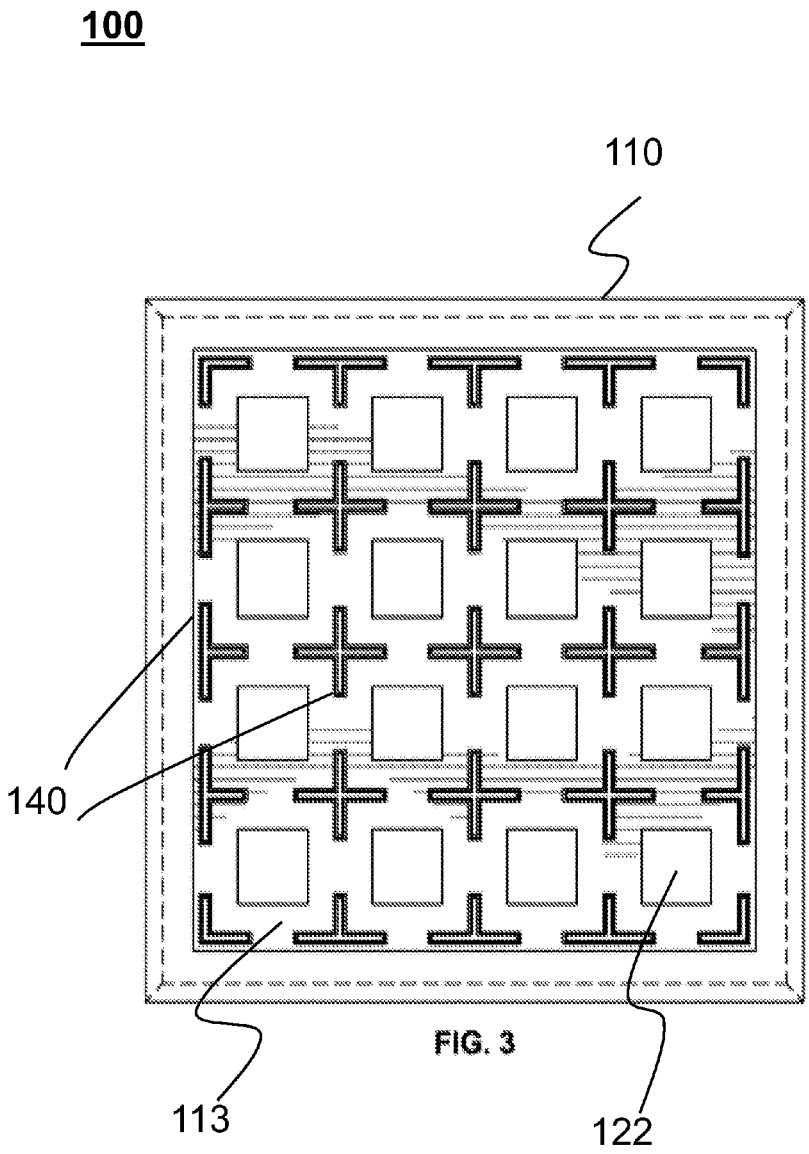
FIG. 3 shows a plan view of the jewelry setting of FIG. 1, according to aspects of the present invention.

FIG. 3 shows a plan view of the jewelry setting of FIG. 1, according to aspects of the present invention.

FIG. 3 shows a plan view of the setting 100. The +, T and L shapes formed by the short braces 140 are more clearly depicted in this drawing.

The braces form symmetric shapes in the drawing shown. However, braces having asymmetric walls may be used in other aspects of the present invention. Further, walls arranged in other shapes, such as X and < or and, may be used in various aspects of the present invention. As long as the setting is such that the sunk surface is located between the top and bottom of the base of the setting, the cavities have a bottom opening for the pavilion, the passage of light through the pavilion is not obstructed from the bottom. The braces are arranged to leave openings in the enclosures around each cavity. The carpet effect is achieved when looking at the finished jewelry from above and the passage of light between the gemstones remains unobstructed on the sides through the openings between the braces. Accordingly, various equivalent shapes and arrangements of braces fall within various aspects of the present invention.

Figure 4:
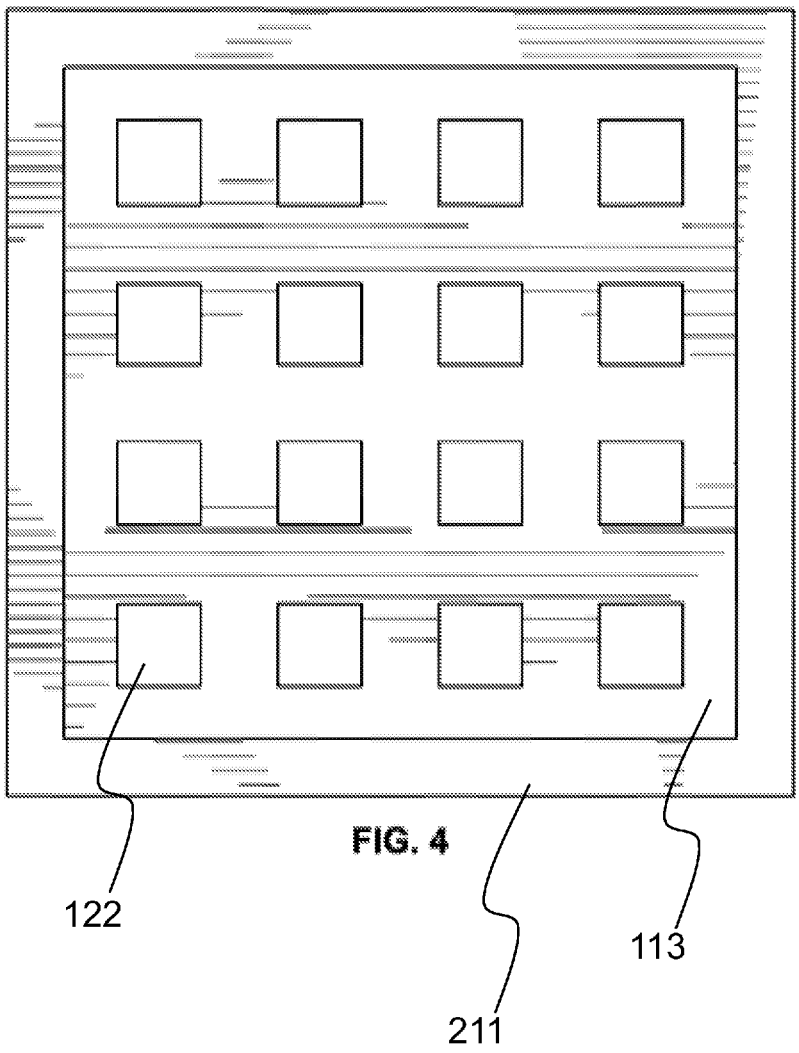
FIG. 4 shows a back view of the jewelry setting of FIG. 1, according to aspects of the present invention.

FIG. 4 shows a back view of the jewelry setting of FIG. 1, according to aspects of the present invention.

A back view of the setting 100 is shown in this drawing. From the back, the base bottom 211 and the cavity bottom openings 122 formed in the sunk surface 113 are observable.

These bottom openings are adapted to receive the pavilions of the gemstones placed in each cavity. The bottom openings are shown as rectangular openings formed in the sunk plane corresponding to each cavity.

In various aspects of the present invention, the bottom openings may be formed in other shapes such as a circle, a triangle or a polygon. When openings that do not match the pavilion of the gemstone are used, light may pass from around the pavilion to the portion of the pavilion above the sunk surface. When the shape of the bottom opening fits the shape of the pavilion and no space remains between the pavilion and the sunk surface through the bottom opening, then light passes through the pavilions upward.

Figure 5:
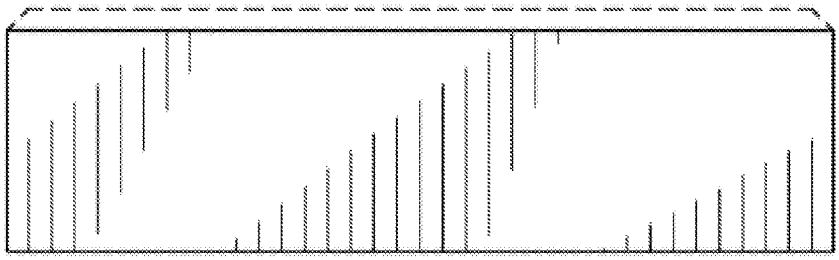
FIG. 5 shows a side view of the jewelry setting of FIG. 1, according to aspects of the present invention.
Figure 6:
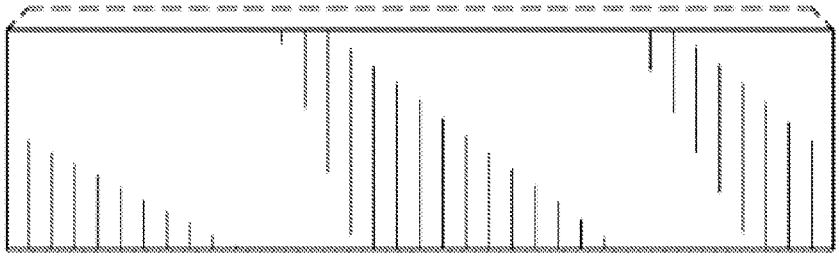
FIG. 6 shows another side view of the jewelry setting of FIG. 1, according to aspects of the present invention.

FIG. 5 shows a side view of the jewelry setting of FIG. 1, according to aspects of the present invention. FIG. 6 shows another side view of the jewelry setting of FIG. 1, according to aspects of the present invention.

FIGS. 5 and 6 show side views of the setting 100. Because the setting 100 is shown as a rectangular box with both top and bottom being open and a sunk surface located between the top and bottom, the sides are also rectangular.

A design created on the base top 111 would be apparent in the side views if the design protrudes above the base walls 112.

In other embodiments, the base may have a different shape such as a trapezoidal shape that narrows downward or upward. In that case, the side views would appear as trapezoids.

Figure 7:
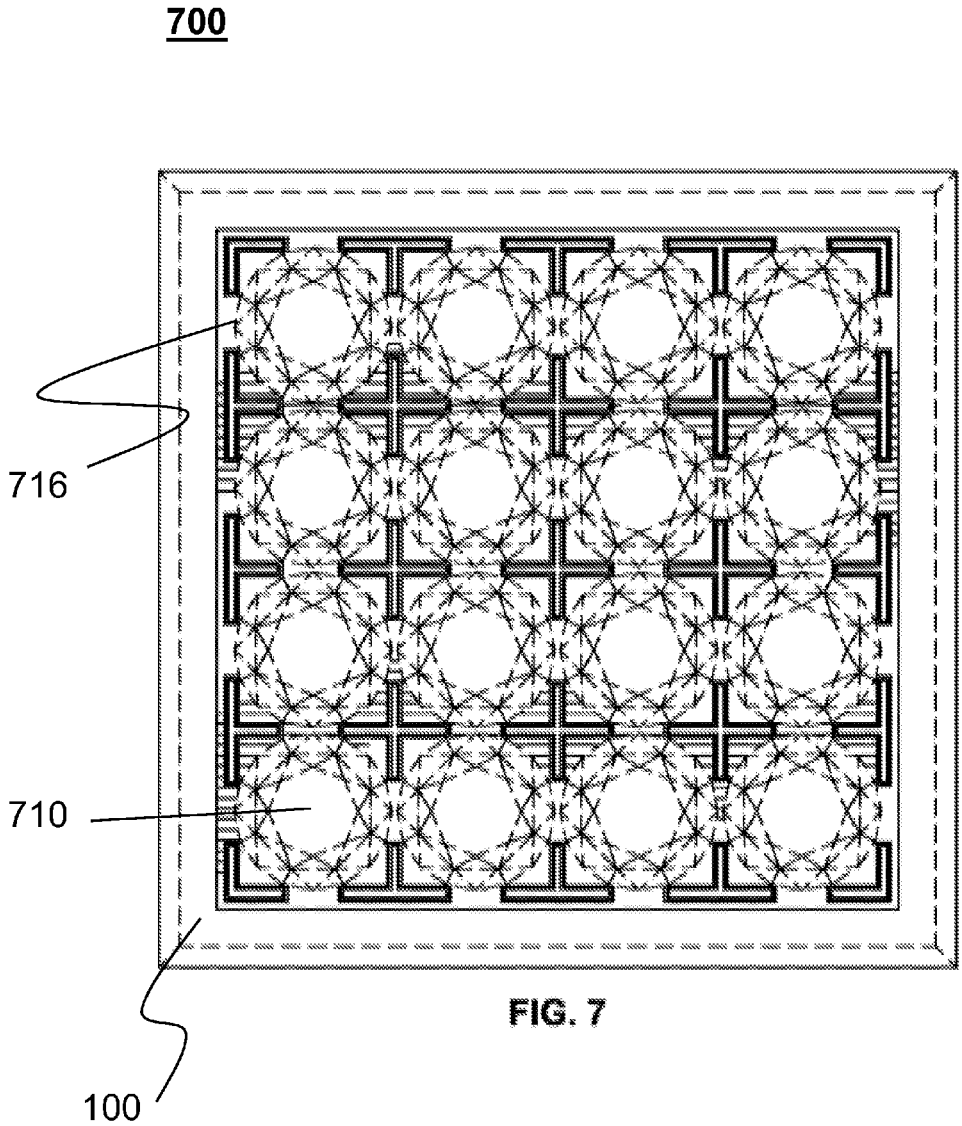
FIG. 7 shows a plan view of a jewelry apparatus, according to aspects of the present invention.

FIG. 7 shows a plan view of a jewelry apparatus, according to aspects of the present invention.

In FIG. 7, a jewelry apparatus 700 is shown. Placement of gemstones 710 in the setting 100 forms the jewelry apparatus 700. The gemstones 710 are round and they are placed in the cavities 120 such that girdles 716 of two adjacent gemstones are close and appear continuous. The open walls of the cavities 120 formed between the braces 140 accommodate the close placement of the gemstones 710. These open walls, formed by the spaced between the braces 140, also accommodate passage of light from one gemstone to an adjacent one.

Figure 8:
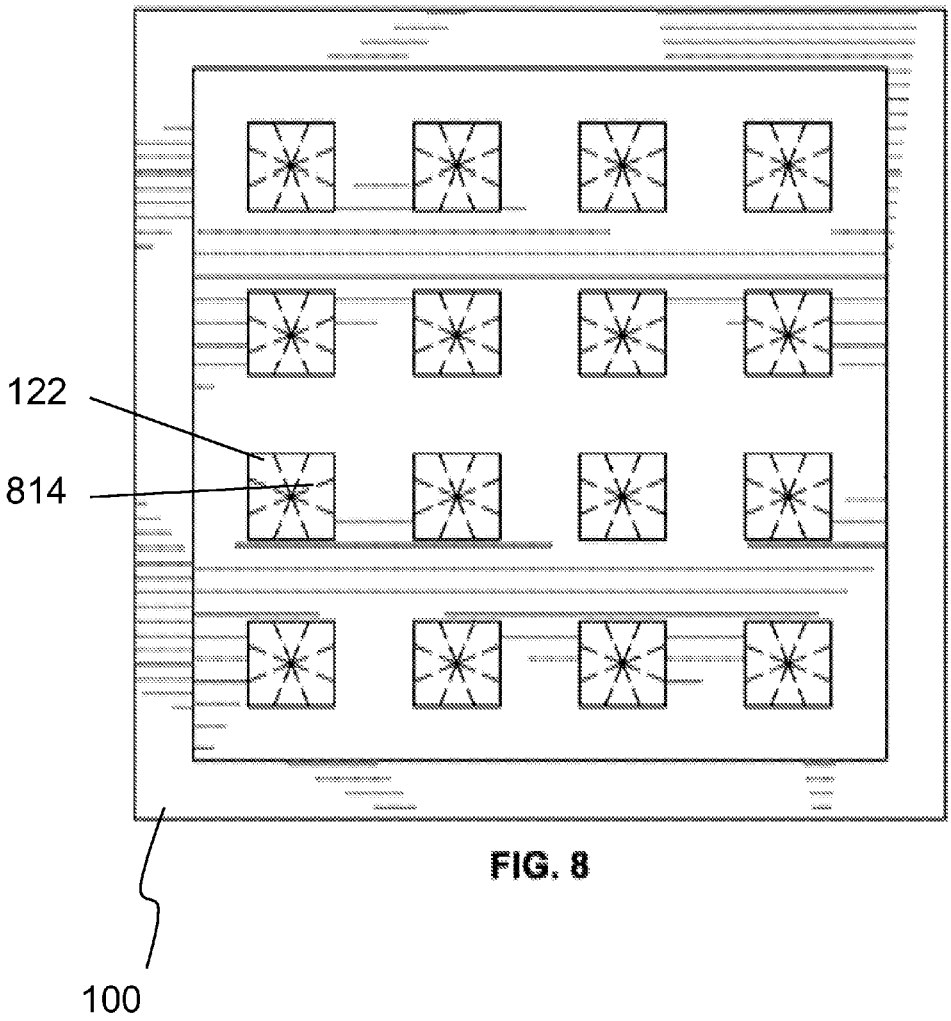
FIG. 8 shows a back view of the jewelry apparatus of FIG. 7, according to aspects of the present invention.
Figure 9:
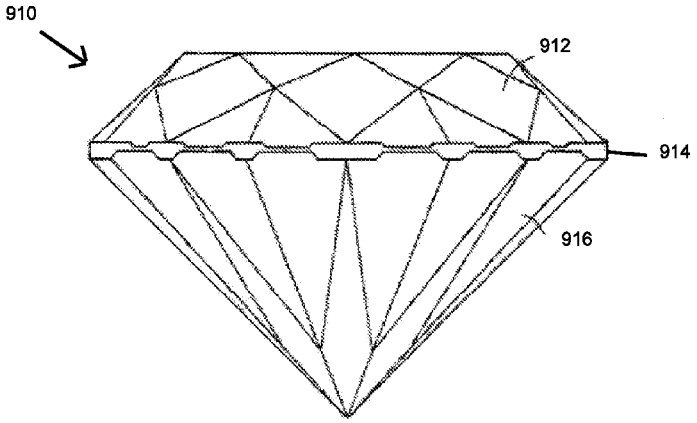
FIG. 9 PRIOR ART
FIG. 9 shows a conventional gemstone.

FIG. 8 shows a back view of the jewelry apparatus of FIG. 7, according to aspects of the present invention.

Back view of the jewelry apparatus 700 is shown in FIG. 8. The pavilions 814 of the each gemstone 710 protrude from the cavity bottom opening 122 and may be observed in this drawing.

The pavilions of the gemstones shown in FIG. 8 have a type of cut that fits the rectangular openings 122 in the bottom of each cavity.

FIG. 10A, FIG. 10B, FIG. 10C, FIG. 10D, FIG. 10E and FIG. 10F show various jewelry items including different types of carpet setting, according to the aspects of the present invention.

Figure 10A:
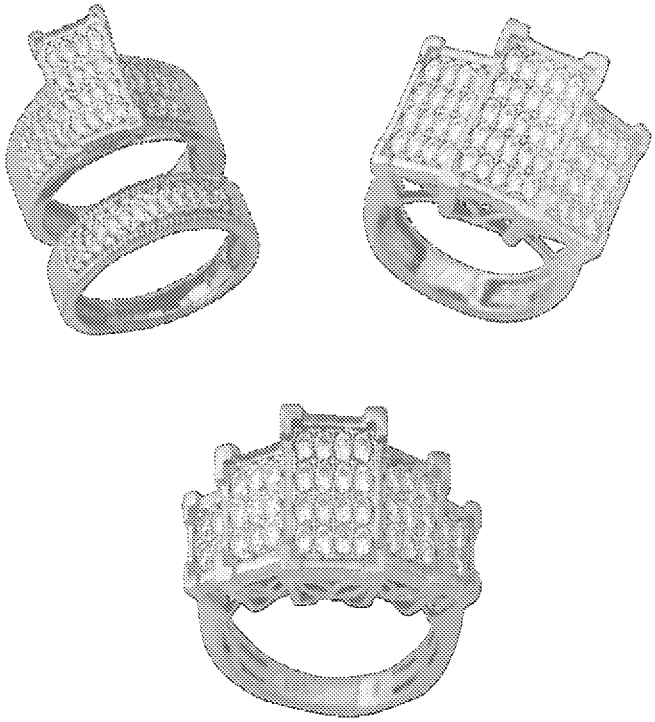
FIG. 10A, FIG. 10B, FIG. 10C, FIG. 10D, FIG. 10E and FIG. 10F show various jewelry items including different types of carpet setting, according to the aspects of the present invention.
Figure 10B:
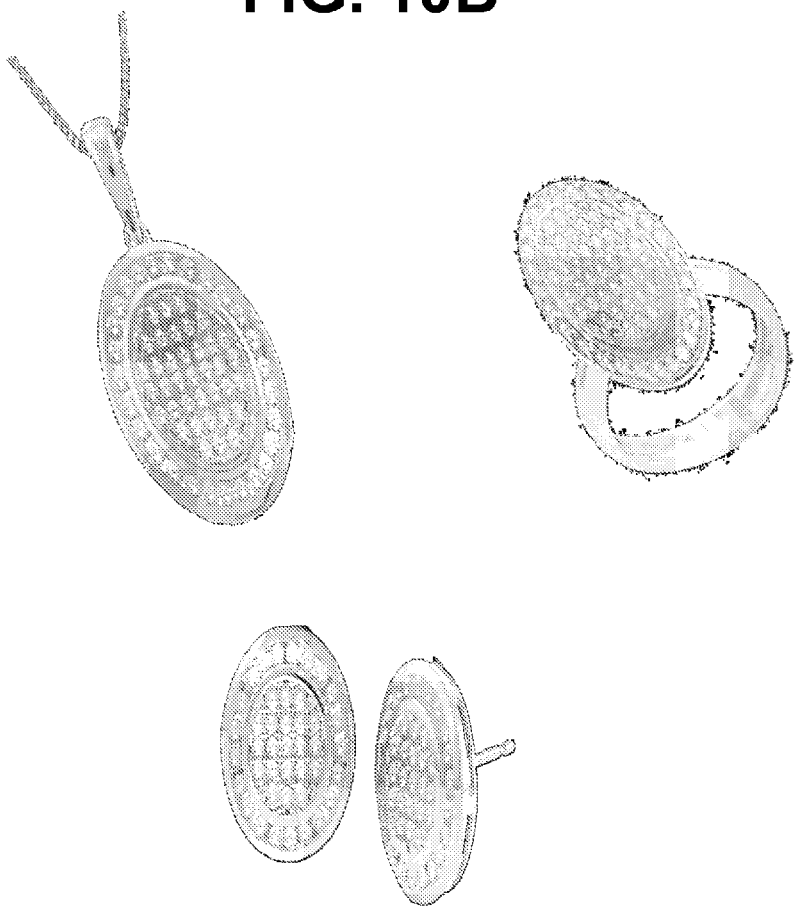
Figure 10C:
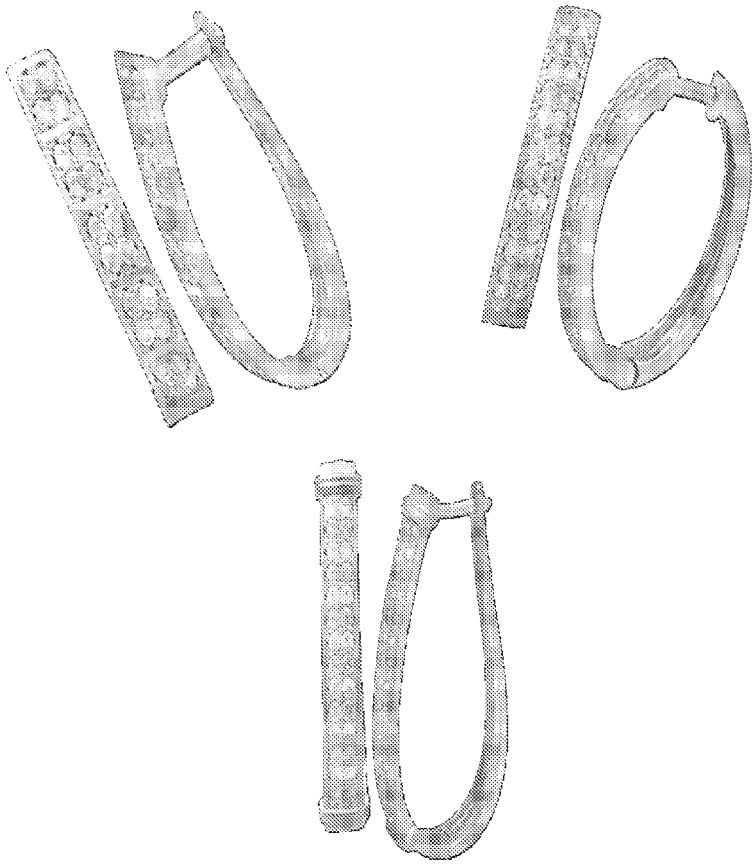
Figure 10D:
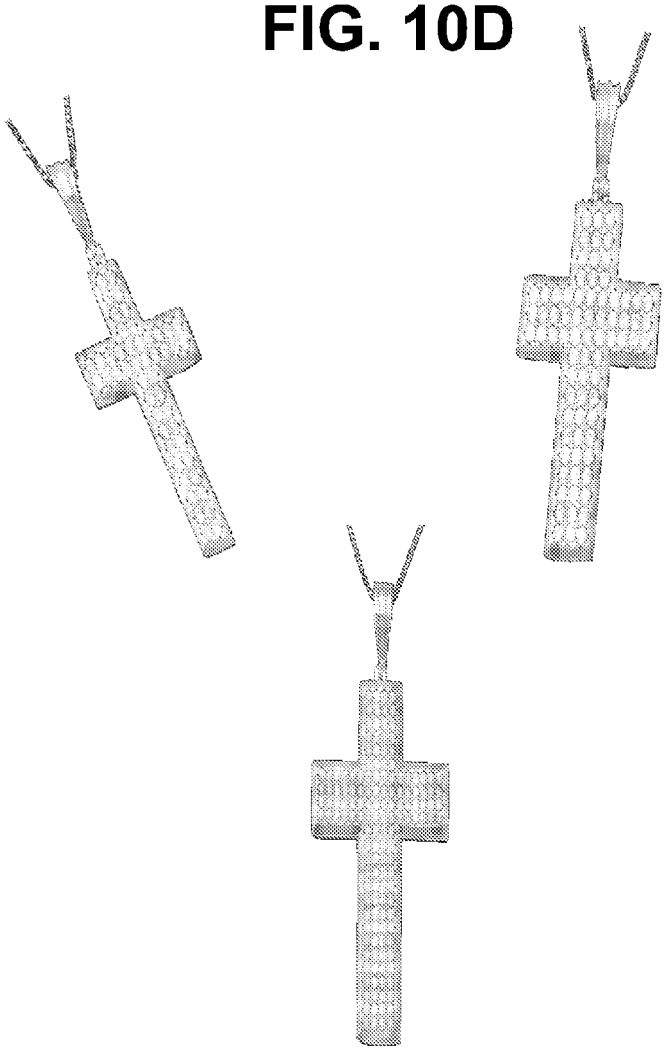
Figure 10E:
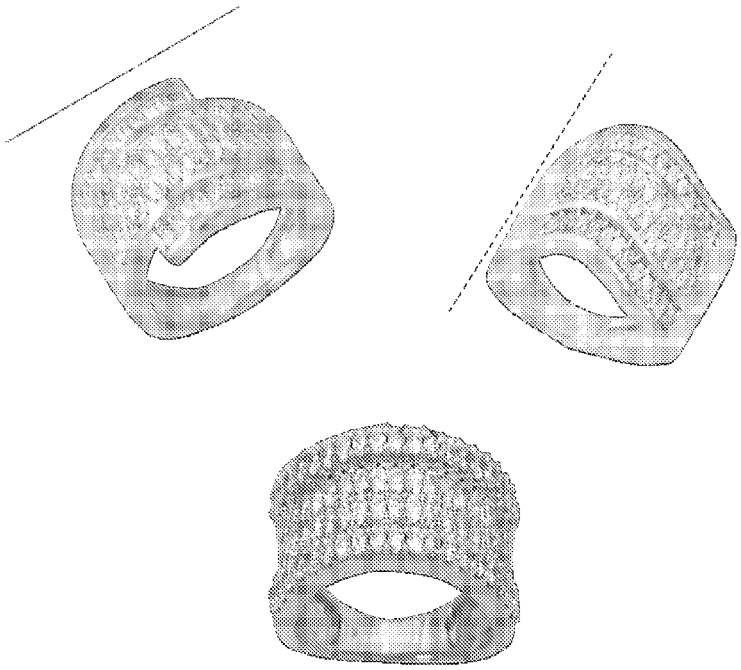
Figure 10F:
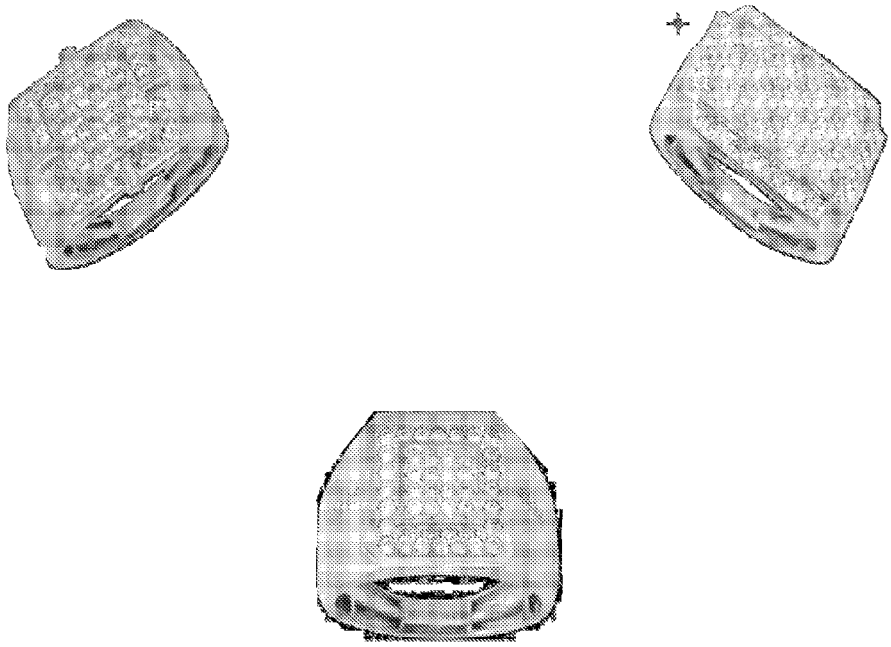

FIG. 10A shows the use of carpet setting in various rings. The settings shown in this drawing have rectangular outlines and the base of the gemstones is at times a curved surface to fit the fingers. FIG. 10B shows the use of carpet settings in rings, earrings and necklaces where the settings have circular outlines. FIG. 10C shows the use of carpet settings in ring shaped earrings where settings have rectangular outlines. FIG. 10D shows the use of carpet setting in cross-shaped pendants. FIG. 10E shows the use of carpet settings in rings where the setting has a curved base to fit the fingers. FIG. 10F shows the use of carpet settings in rings where the gemstones are placed in planar bases with rectangular outlines. These drawings show examples of various arrangements in which the carpet setting may be successfully utilized.

Figure 11:
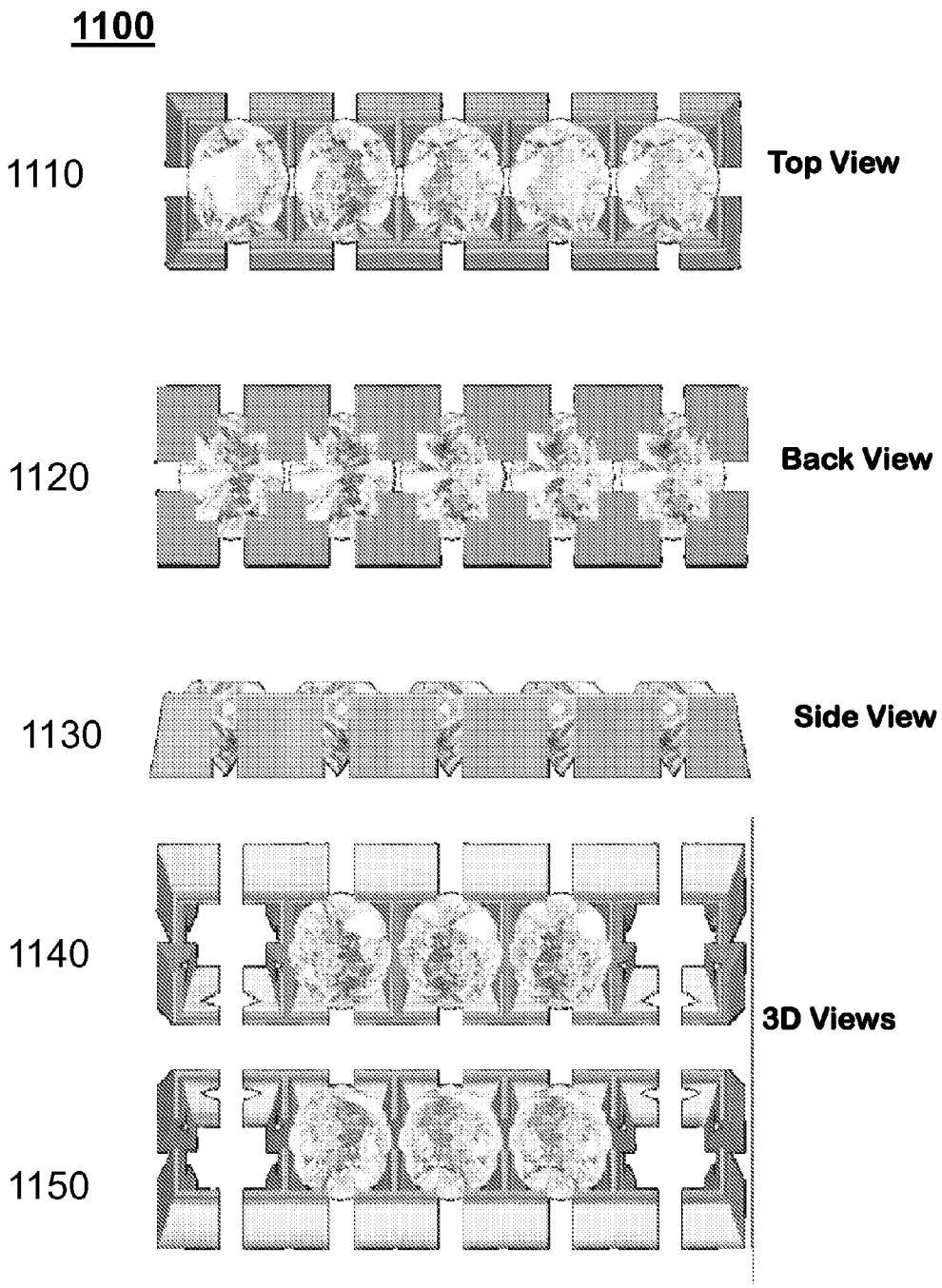
FIG. 11 shows various views of a jewelry apparatus, according to other aspects of the present invention.

FIG. 11 shows various views of a jewelry apparatus, according to other aspects of the present invention.

FIG. 11 shows a plan view 1110, a back view 1120, a side view 1130 and two perspective views 1140, 1150 of a jewelry apparatus 1100 according to another aspect of the present invention.

A setting used in the jewelry apparatus 1100 is similar in some features to the setting 100. However, the two are different in some respects. As the plan view 1110 and the perspective views 1140, 1150 show, the cavities of the jewelry apparatus 1100 have walls that taper down toward the cavity bottom opening and to some degree follow the pavilion of the gemstone. Further, as the perspective views 1140, 1150 indicate, the cavity walls include notches that hold the gemstone in place. The girdle of the gemstone is located in the notch while the crown extends up and in some cases above the external walls of the setting.

Figure 12:
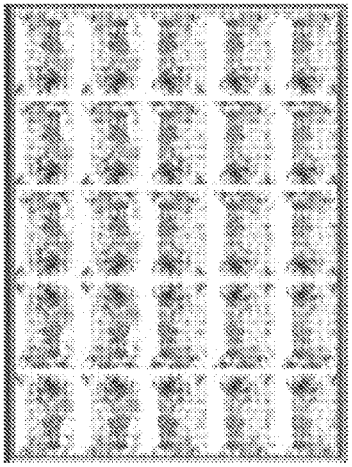
FIG. 12 shows a comparison between the carpet setting of the aspects of the present invention, a prior art invisible setting and a prior art micropave setting.
Figure 12:
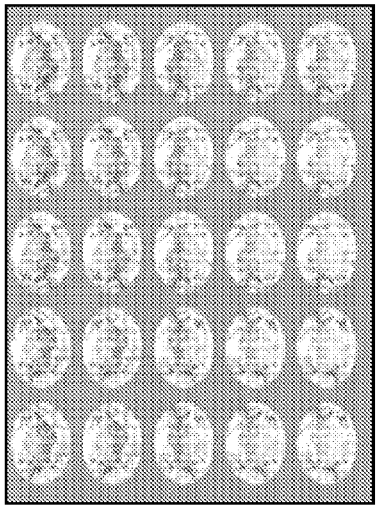
Figure 12:
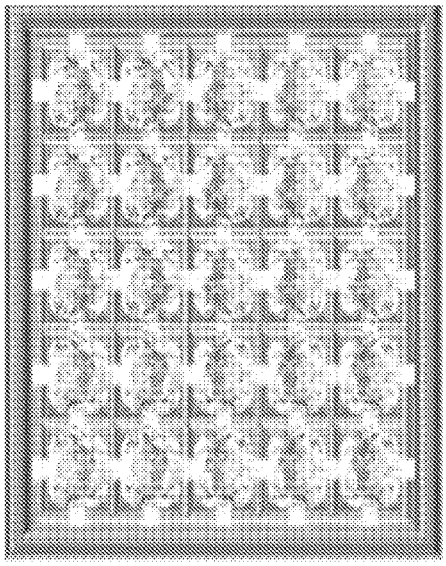

FIG. 12 shows a comparison between the carpet setting of the aspects of the present invention, a prior art invisible setting and a prior art micropave setting.

FIG. 12 shows a carpet setting 1210, according to aspects of the present invention, an invisible setting 1220 and a micropave setting 1230 as available in the prior art. All three settings use diamonds that are 0.25 carrots in weight and 1 ptr in size. The carpet setting and the micropave use round diamonds and the invisible setting uses princess cut diamonds. The settings have comparable overall dimensions with the carpet setting of the aspects of the present invention having the largest length and width. Yet, the carpet setting has a lower price ($89.32) when compared to the micropave ($98.00) and the invisible ($120.63) settings.

The present invention has been described in relation to particular examples, which are intended to be illustrative rather than restrictive, with the scope and spirit of the invention being indicated by the following claims and their equivalents.

The invention claimed is:

1. A jewelry setting for securing a plurality of gemstones within the setting, comprising:

a base including a base top, four base walls circumscribing the base, four corners and a base bottom;

a sunk surface located between and substantially parallel to said base top and said base bottom and having at least two rows of rectangular apertures extending through said sunk surface;

each said aperture being surrounded by four walls, said walls partially circumscribe said aperture with gaps located between each adjacent wall of said four walls, said walls extending a distance from and above the sunk surface, but not beyond said base top receiving and securing said gemstone therein, said walls having either a plus-shape, T-shape or L-shape cross section, wherein said gemstone is secured at its girdle between said four walls surrounding said rectangular aperture with the crown of the gemstone being positioned above said four walls and the pavilion of the gemstone being positioned through said rectangular aperture in said sunk surface.

2. The jewelry setting of claim 1, wherein the setting is made from metal.

3. The jewelry setting of claim 1, wherein the sunk surface is a planar surface.

4. The jewelry setting of claim 1, wherein the sunk surface is a curved surface adapted for forming a ring, an earring, a choker, a bracelet, an anklet or an arm band.

5. The jewelry setting of claim 1, wherein the said four walls of each of the cavities are straight walls perpendicular to the sunk surface.

6. The jewelry setting of claim 1, wherein the said four walls of each of the cavities are tapered walls reaching the sunk surface at an angle adapted for fitting the pavilion of the gemstone.

7. The jewelry setting of claim 1, wherein the cavities are arranged in rows.

8. The jewelry setting of claim 1, wherein the apertures are selected from triangular, circular, rectangular or polygonal in perimeter.

9. The jewelry setting of claim 1, wherein the gemstones are substantially the same size.

10. The jewelry setting of claim 1, wherein the gemstones are round.

11. The jewelry setting of claim 1, further comprising:

the gemstones fitted in the cavities to form a jewelry apparatus.

12. The jewelry setting of claim 11, wherein the jewelry apparatus is selected from a group consisting of a ring, an earring, a bracelet, an anklet, a choker, a necklace and a pendant.

13. The jewelry setting of claim 11, wherein the gemstones are diamonds.

14. A method for forming a jewelry apparatus, the method comprising:

forming a setting comprising a base including a base top, four base walls circumscribing the base, four corners and a base bottom;

a sunk surface located between and substantially parallel to said base top and said base bottom and having at least two rows of rectangular apertures extending through said sunk surface;

each said aperture being surrounded by four walls, said walls partially circumscribe said aperture with gaps located between each adjacent wall of said four walls, said walls extending a distance from and above the sunk surface, but not beyond said base top receiving and securing said gemstone therein, said walls having either a plus-shape, T-shape or L-shape cross section, wherein said gemstone is secured at its girdle between said four walls surrounding said rectangular aperture with the crown of the gemstone being positioned above said four walls and the pavilion of the gemstone being positioned through said rectangular aperture in said sunk surface;

fitting gemstones in the apertures of the setting; and holding the gemstones in the apertures by gaps formed in the four walls.

15. The method of claim 14, wherein girdles of the gemstones are fitted above the four walls and the girdles of adjacent gemstones approach each other through the gaps.

16. The method of claim 14, wherein the pavilions of the gemstones protrude through the apertures and receive light from below the setting.

* * * * *